US005895024A

United States Patent [19]

Williams et al.

[11] Patent Number: 5,895,024

[45] Date of Patent: Apr. 20, 1999

[54] COLLAPSIBLE HOLDER FOR WARNING DEVICES

[75] Inventors: Jeffrey A. Williams; Grant D. Dicke, both of Downers Grove, Ill.

[73] Assignee: Dicke Tool Company, Downers Grove, Ill.

[21] Appl. No.: 08/911,867

[22] Filed: Aug. 15, 1997

[51] Int. Cl.[6] ..... G09F 15/00

[52] U.S. Cl. ..... 248/513; 40/610; 248/291.1; 248/514; 248/534; 403/102

[58] Field of Search ..... 248/513, 514, 248/537, 539, 291.1, 534; 40/606, 110, 612; 403/100, 101, 102

[56] References Cited

U.S. PATENT DOCUMENTS

| | | | |
|---|---|---|---|
| 1,131,699 | 3/1915 | Hoecker et al. | 248/539 X |
| 1,203,937 | 11/1916 | Surface . | |
| 1,575,614 | 3/1926 | Blaw | 248/514 X |
| 1,651,221 | 11/1927 | O'Maley . | |
| 1,788,102 | 1/1931 | Gilbert | 403/100 |
| 2,167,564 | 7/1939 | Fonda | 40/606 |
| 2,277,981 | 3/1942 | Horton | 248/537 X |
| 3,171,626 | 3/1965 | Keats | 248/122 |
| 3,200,786 | 8/1965 | Swezy et al. | 116/63 |
| 3,825,214 | 7/1974 | Ciolfi | 248/539 |
| 4,019,271 | 4/1977 | Latimer | 40/125 |
| 4,270,239 | 6/1981 | Gross | 403/100 X |
| 4,288,053 | 9/1981 | Sarkisian | 248/218 |
| 4,309,836 | 1/1982 | Knapp | 40/602 |
| 4,433,935 | 2/1984 | Main et al. | 403/385 |
| 4,572,473 | 2/1986 | Seely | 248/624 |
| 4,619,220 | 10/1986 | Seely et al. | 116/63 |
| 4,662,305 | 5/1987 | Cline | 116/173 |
| 4,865,287 | 9/1989 | Stoudt | 248/513 |
| 4,905,391 | 3/1990 | Dillon | 40/610 |
| 4,980,984 | 1/1991 | Kulp et al. | 40/610 |
| 5,152,091 | 10/1992 | Leach | 40/603 |
| 5,197,408 | 3/1993 | Stoudt | 116/173 |
| 5,231,778 | 8/1993 | Belobraydich et al. | 40/610 |
| 5,309,862 | 5/1994 | Lang | 116/173 |
| 5,318,258 | 6/1994 | Lang | 248/166 |
| 5,438,782 | 8/1995 | Belobraydich et al. | 40/610 |
| 5,572,836 | 11/1996 | Parker | 116/173 X |

*Primary Examiner*—Derek J. Berger
*Attorney, Agent, or Firm*—Fitch, Even, Tabin & Flannery

[57] ABSTRACT

A mounting for warning devices includes a body having one or more outwardly extending finger portions. Mounting staffs aligned with the finger portion are secured thereto with a sliding collar which surrounds both the mounting staff and finger portions. The mounting staffs may be pivotally joined to the body, adjacent each finger portion. The body portion may be mounted from an upright support member, secured to a stationary or mobile support.

11 Claims, 10 Drawing Sheets

COLLAPSIBLE HOLDER FOR WARNING DEVICES

BACKGROUND OF THE INVENTION

1. Field of the Invention

The present invention pertains to mounting arrangements for warning devices such as warning flags and warning lights.

2. Description of the Related Art

Warning flags are often used by work crews to attract attention to a warning sign or to direct the attention of bystanders to an unusual traffic or other work site condition. U.S. Pat. Nos. 5,309,862; 5,318,258; 5,197,408; 4,980,984; 4,865,287; 4,619,220; 4,288,053 and 1,203,937 show various arrangements for displaying warning flags in close proximity to warning signs of the type used adjacent a highway or roadway. Largely as a result of a use of motor vehicles by construction crews and emergency personnel, it has been found desirable to provide warning signs with a roll-up capability for a reduced size during transport. While there are a number of arrangements, such as those disclosed in U.S. Pat. Nos. 5,309,862; 5,318,258; 5,152,091; 4,980,984; 4,619,220 and 3,200,786 which have incorporated flag holders with warning signs which can be rolled up into a more compact package for storage, usually in a motor vehicle as part of the standard equipment provided to the work crew or emergency personnel with the vehicle. U.S. Pat. No. 1,203,937 shows a flag holder for automobiles and it has been found desirable to attract attention to a moving vehicle using warning flags. Despite improvements over the years, further reductions in weight, bulk and production costs have been sought.

SUMMARY OF THE INVENTION

It is an object of the present invention to provide a mounting for warning devices such as flags and lights which allows the overall warning system to be collapsed to a smaller size.

Another object of the present invention is to provide a mounting of the above-described type which is simple and easy to operate without requiring previous training.

Another object of the present invention is to provide a mounting arrangement of the above-described type which is easily operable out-of-doors, even in inclement conditions, and while wearing gloves and bulky outer clothing.

Another object of the present invention is to provide a mounting arrangement suitable for use with vehicles as well as stationary warning signs.

These and other objects of the present invention, which will become apparent from studying the appended description and drawings, are provided in an apparatus for displaying a plurality of warning devices, comprising:

a body including a plate portion with a plurality of spaced apart fingers, including a first finger, extending in a first direction therefrom;

pivot means adjacent the first finger for pivotally mounting a mounting staff to the body for pivotal alignment in overlying relationship with the first finger; and a sliding band means, slidable along the first finger to surround the overlying mounting staff and finger to prevent further pivoting of the mounting staff with respect to the finger.

DETAILED DESCRIPTION OF THE PREFERRED EMBODIMENTS

Figure 1:
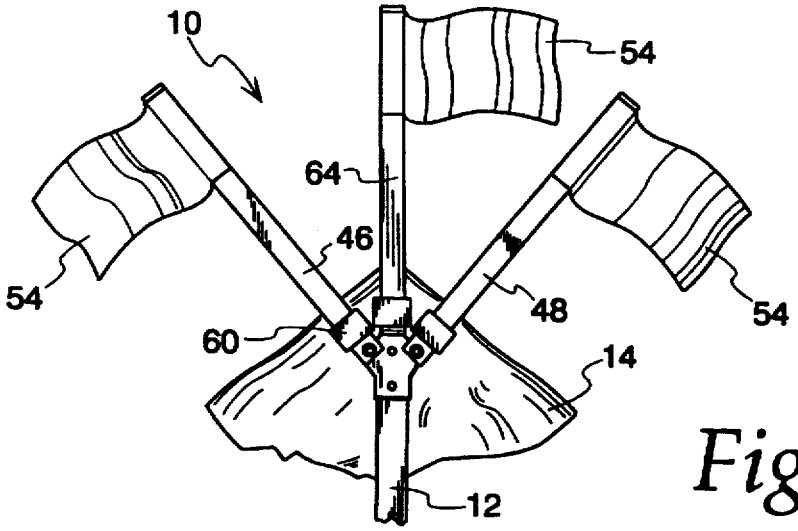
FIG. 1 is a front elevational view of a warning sign and a flag mounting arrangement for use therewith.

Referring now to the drawings, and initially to FIGS. 1–7, a mounting arrangement for warning devices is generally indicated at 10. In the embodiment shown in FIG. 1, the mounting arrangement is attached to the upper end of a vertical support member or rib member 12. Rib member 12 forms part of a conventional "roll-up" sign panel assembly for displaying a flexible sign panel 14 and is sometimes referred to as a vertical cross brace of the sign panel assembly. As is known in the art, the rib member 12 is secured (by means not shown) to the upper corner of the flexible sign panel.

Figure 4:
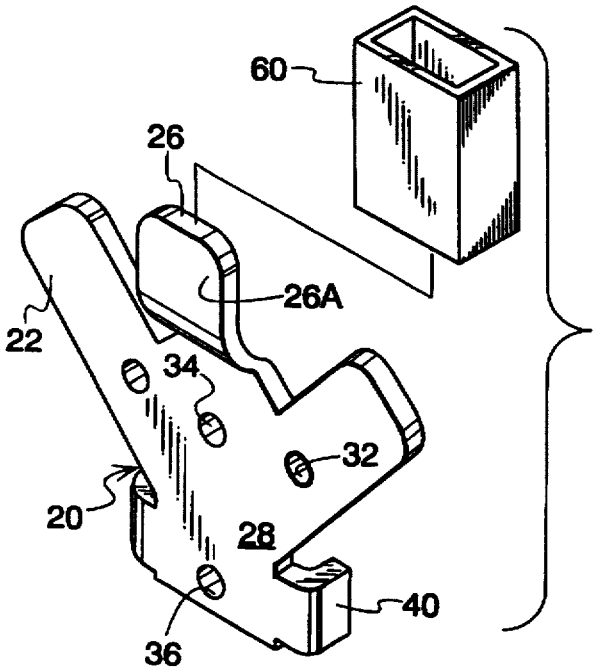
FIG. 4 is a perspective view of a mounting bracket employed in the arrangement shown in the preceding Figures.
Figure 5:
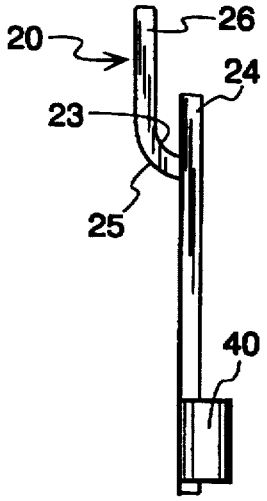
FIG. 5 is a side elevational view thereof.

Mounting arrangement 10 preferably includes a mounting bracket, generally indicated at 10, and shown in FIGS. 4 and 5. If desired, however, the vertical rib 12 could be employed separately, apart from the sign panel and could have as its principal function, elevating the mounting bracket 20. In a preferred embodiment, rib member 12 is of a conventional fiber glass or aluminum construction. If desired, however, rib 12 can be changed from a flat rib or bar-like configuration to that of a pole either fixed or telescopically extendable. In some arrangements, the upright support member 12 could be regarded as part of the mounting arrangement 10.

Referring to FIGS. 4 and 5, the mounting bracket 26 includes a plate-like body portion which is preferably stamped from sheet metal, but which could also be cast from metal, plastic or other suitable material. Mounting bracket 20 includes a plurality of fingers at its upper end, including outer fingers 22, 24 and a central finger 26. In a preferred embodiment, the outer fingers 22,24 lie in the same plane as the central portion 28 of the bracket body. Apertures 30, 32 are provided for the finger portions 22, 24 and apertures 34, 36 are located along the vertical center line of the mounting bracket body. The aperture 34 provides a first means of securement to rib 12, using a threaded fastener 50. If desired, however, threaded apertures 34 and/or 36 may provide securement to a supporting surface. For example, threaded fastener 50 may be received in the apertures 34, 36 to mount the bracket 20 to a wall or other support surface. In the preferred arrangement, however, a pair of ears 40 is provided at the lower end of the mounting bracket body to prevent rotation of the mounting bracket about the vertical rib 12. The ears are preferably about as thick as the rib 12. However, the ears 40 may be replaced by a mounting band to compressibly engage the support rib 12 by being pressed or clinched about the upper end of the upright support member. Substantially the entire portion of mounting bracket 20 is coplanar except for central finger 26, which is offset to one side of the central plane of the mounting bracket.

Figure 2:
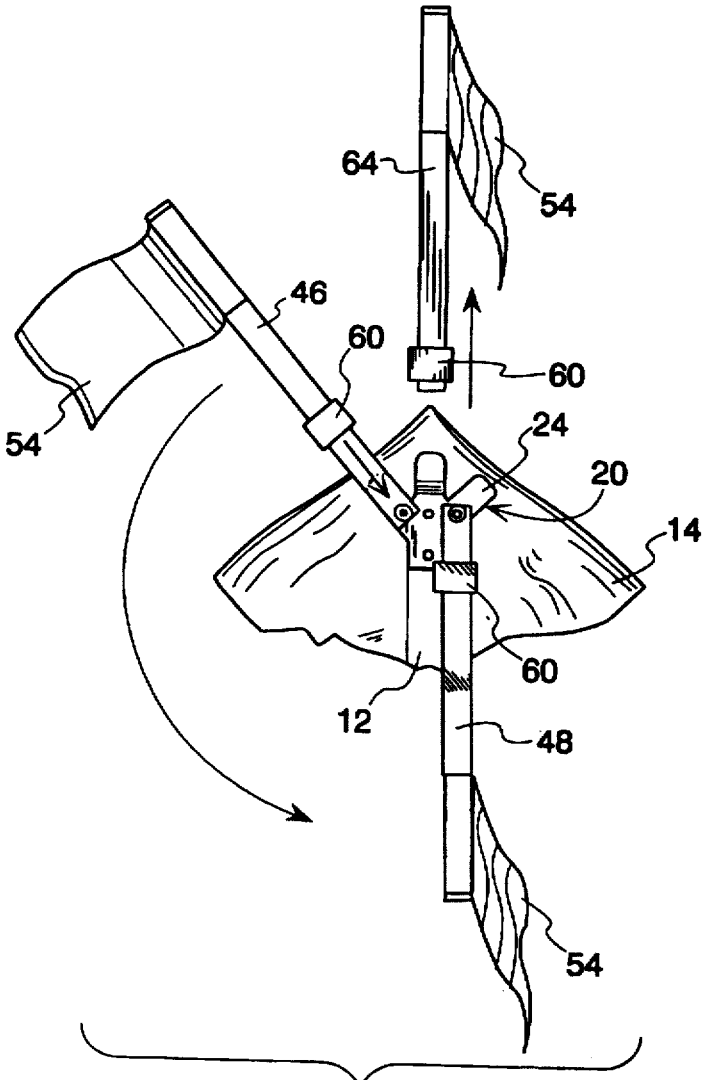
FIG. 2 shows the arrangement of FIG. 1 in an exploded, partially disassembled condition.
Figure 3:
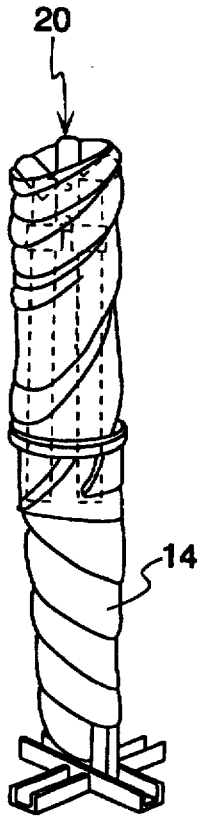
FIG. 3 shows the arrangement rolled up, ready for storage.
Figure 6:
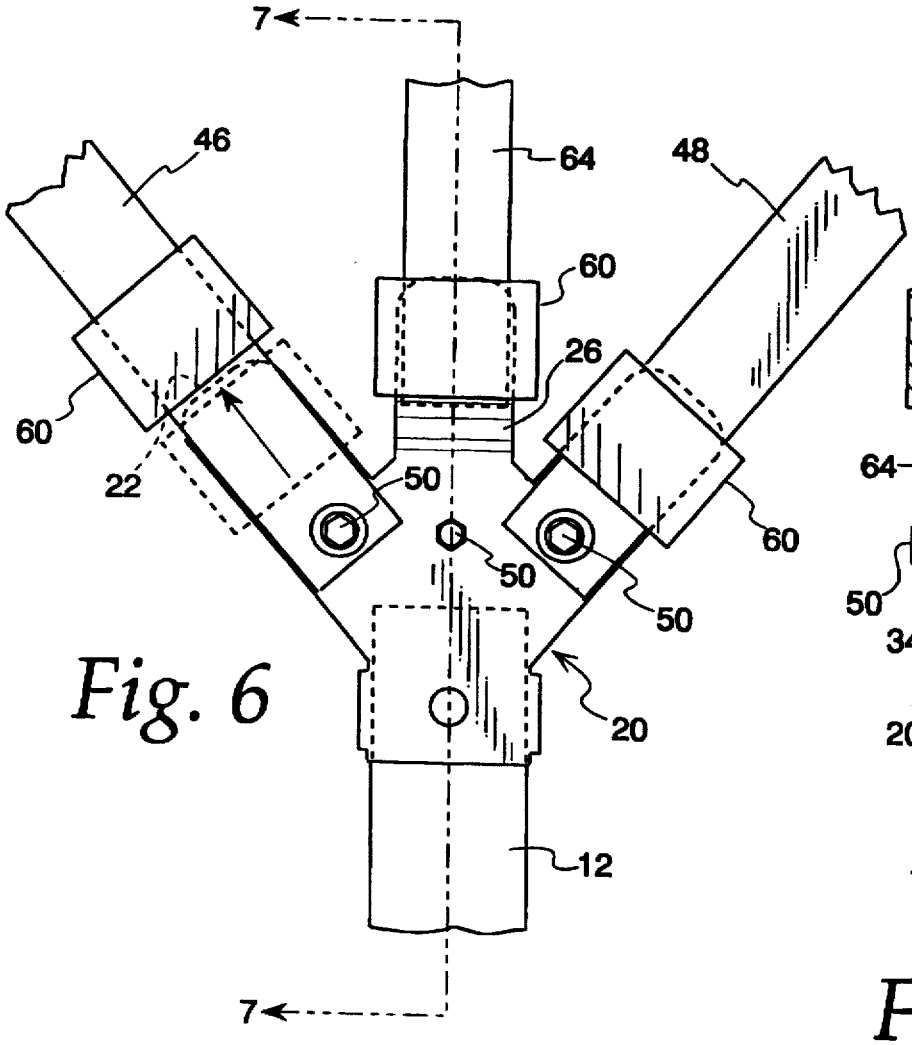
FIG. 6 is a fragmentary view of FIG. 1 shown on an enlarged scale.

Referring to FIG. 6, and also to FIGS. 1 and 2, a pair of mounting staffs 46, 48 are mounted to respective fingers 22, 24 by pivot means, such as rivets or threaded fasteners 50, shown in the figures. The staffs 46, 48 are pivoted from an open or displayed position shown in FIG. 1 to a collapsed or storage position, located alongside the upright support member 12, as shown in FIG. 2. In the storage position, the staffs (and flags) are folded to form a very compact package, as can be seen from examining FIG. 2. Although not necessary, it is generally preferred that the staffs 46, 48 be maintained generally parallel to the plane of the central plate portion of mounting bracket 20. The mounting staffs 46, 48 preferably have a flat rib configuration and, as can be seen in FIG. 6, the outside fingers 22, 24 have a width corresponding generally to the width of the staffs 46, 48. In the preferred embodiment shown in FIGS. 1–3, the warning devices preferably comprise flags 54 secured to the upper free ends of mounting staffs 46, 48. If desired, other types of warning devices, such as flashing lights or reflectors, could be employed, as will be seen herein.

Figure 7:
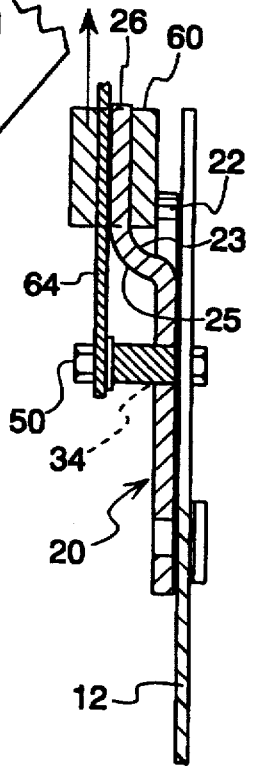
FIG. 7 is a cross-sectional view taken along the line 7—7 of FIG. 6.

Each staff 46, 48 has a respective sliding collar 60 which is dimensioned to be telescopically slidable along the mounting staffs 46, 48. As indicated in FIGS. 6 and 7, the sliding collars 60 are dimensioned to fit around the overlapping joinder of the mounting staffs and their respective bracket finger portions. As can be seen in FIG. 7, the sliding collars 60 hold the lower portions of the ribs captive in their fully opened positions. When the indicating devices are set up in the fully displayed position shown in FIG. 1, the staffs 46, 48 are pivoted into alignment with their respective finger portions 22, 24 and the sliding collars 60 are then slid or fall on their own under force of gravity in a downward direction to surround the overlapping joinder of the mounting staff and finger as shown in FIGS. 6 and 7.

In the preferred embodiment, the sliding collars 60 are preferably made of plastic material, but could also be made of metal or a composite material, if desired. The sliding collars 60 preferably define a uniformly sized opening throughout. However, as will be explained in greater detail below, the sliding collars could be designed with a narrowed or constricted opening size at their upper ends as seen in FIG. 7 so as to provide a wedging together of the overlapping joinder of the collar, mounting staff and finger portion, further fixing the sliding collars 60 in their locked positions illustrated in FIGS. 1 and 6, aiding the force of gravity tending to maintain the sliding collars in their locked positions.

As indicated in FIG. 6, the upper ends of the sliding collars 60 extend approximately to the upper end of the finger portions 22, 24, although the sliding collars could extend further toward the free ends of the mounting staffs 46, 48, projecting beyond the finger portions 22, 24, if desired.

As described above, the mounting arrangement of the present invention accommodates a pair of outside mounting staffs arranged at an inclined or V-shaped relationship to each other. However, the mounting arrangement of the present invention can accommodate additional warning devices. For example, as shown in FIGS. 1 and 2, a third, generally vertically oriented mounting staff 64 is provided for a third, centrally located warning flag 54. As indicated in FIG. 2, unlike the mounting staffs 46, 48 which are pivotally mounted to mounting bracket 20, mounting staff 64 is preferably detachable from mounting bracket 20. With reference to FIGS. 6 and 7, mounting staff 64 is aligned with the central finger portion 26 and the sliding collar 60 is then lowered to surround overlying portions of mounting bracket and finger portion to attain the fully locked position indicated in FIGS. 6 and 7. It has been found convenient to employ the stop surface 23 formed by offset 25 (see FIGS. 5 and 7) to easily achieve a desired alignment of the staff 64 with the mounting bracket.

If desired, the sliding collar 60 can be permanently attached to the lower end of mounting staff 64 so that the central mounting staff 64 can be "stab-locked" or telescoped onto the central finger portion 26. With a further alternative, the lower end of mounting staff 64 can be pivotally joined to the central finger portion 26 with a conventional fastener, such as a rivet. However, the amount of offset away from the central plane of the mounting bracket may have to be increased and the mounting staff 64 would have to contact the opposite face of the central finger portion, so as to preclude interfering with the other mounting staffs as the central mounting staff 64 is pivoted in a downwardly directed position, along side the mounting staffs 46, 48 shown in FIG. 2. In this alternative arrangement, the central mounting staff 64 would be rearranged to contact surface 26*a* shown in FIG. 4, as opposed to the arrangement shown in FIG. 7 where a "stab-lock" as opposed to a pivoted arrangement is illustrated. Of course, a disconnected, separate central mounting staff 64 can be mounted by contacting surface 26*a* shown in FIG. 4, if desired. However, in this event, it is recommended that some provision be made to prevent unintentional downward slipping of the central mounting staff 64 below the central finger portion 26. Such accommodations, can include, for example, a collar 60 formed to the lower end of the central mounting staff 64, or even if not so formed, the collar can have a closed bottom end. In another accommodation, the central finger portion 26 can be made generally coplanar with the finger portions 22, 24 so that a mounting staff 64 contacting surface 26*a* if allowed to slide down, would eventually contact the lower ends of mounting staffs 46, 48 pivotally secured to the central mounting bracket with further downward dislocation being halted.

Figure 8:
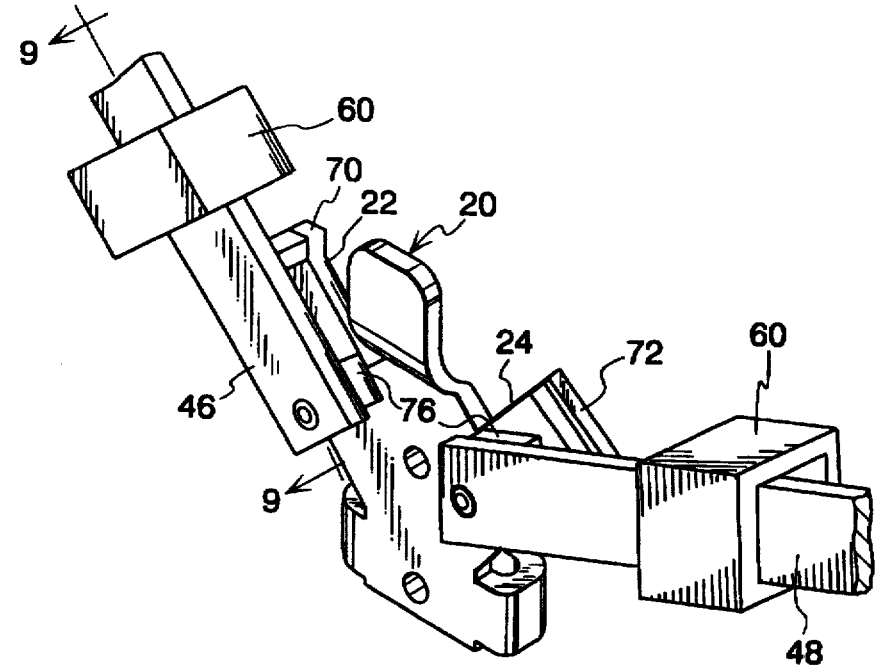
FIG. 8 is a perspective view of an alternative mounting arrangement.
Figure 9:
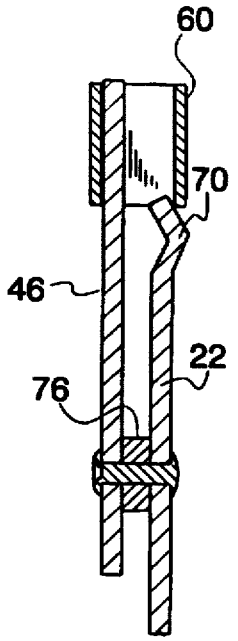
FIG. 9 is a cross-sectional view taken along the line 9—9 of FIG. 8.

As mentioned above, the sliding collars can be dimensioned for a wedge fit with the finger portions or lower ends of the mounting staffs overlying the finger portions so as to provide additional securement of the mounting staffs in their fully open positions. Other arrangements are, however, possible. For example, referring to FIGS. 8 and 9, the outer finger portions 22, 24 are provided with outwardly protruding camming members 70, 72. As can be seen in FIG. 9, some deflection of the mounting staff and finger portion is required to allow the sliding collar to pass the camming member. In a preferred embodiment, the mounting staff 46 comprises a fiber glass flat rib which offers a limited resilience, sufficient to allow deflection toward camming member 70 to allow the upper end of the sliding collar to be seated below the camming member to assume the fully locked position shown, for example, in FIG. 6. If desired, however, the finger portion 22 could also be made of resilient material. To aid in this arrangement, a spacer member 76 (shown with an exaggerated thickness in FIG. 9) is inserted between the mounting staff 46 and finger portion 22. As a further alternative, the spacer member 76 can be omitted, if the sliding collar 60 is made resilient so as to allow passage over the camming member 70.

Figure 10:
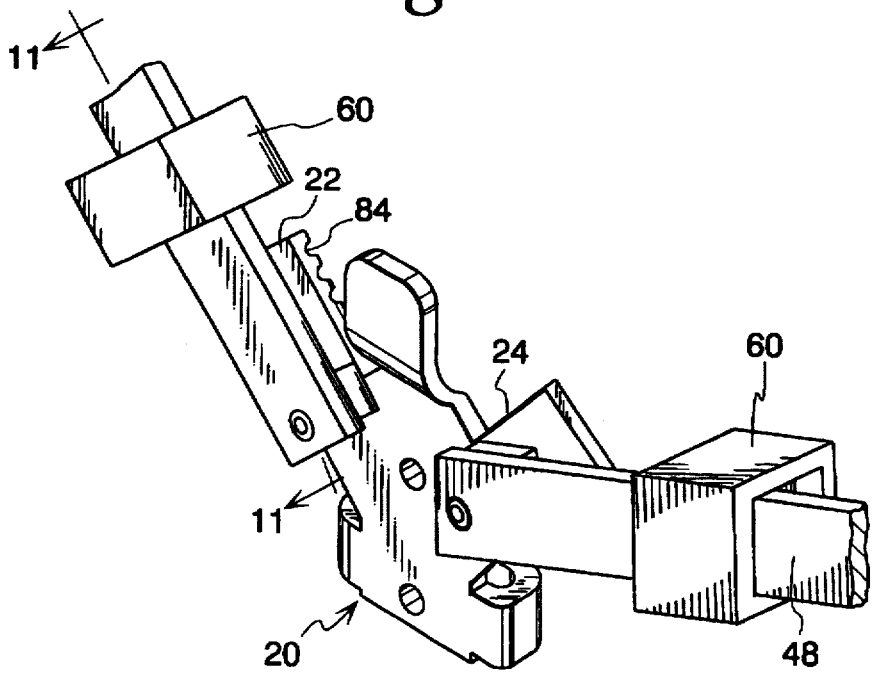
FIG. 10 is a perspective view of another alternative mounting arrangement according to the principles of the present invention.
Figure 11:
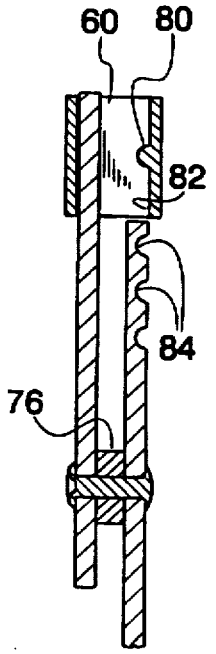
FIG. 11 is a cross-sectional view taken along the line 11—11 of FIG. 10.

Referring to FIGS. 10 and 11, another camming arrangement for the sliding collar 60 is provided internal to the collar itself. As can be seen in FIG. 11, a protrusion 80 is located on an interior bore wall 82 of sliding collar 60. As indicated in FIG. 11, one or more recesses 84 are provided on the finger portion to receive the protrusion 80. As an alternative, the collar 60 of FIG. 11 can be used with the protrusion 70 illustrated in FIG. 9 to provide another arrangement for the secure retention of the sliding collar on the finger portion.

Figure 12:
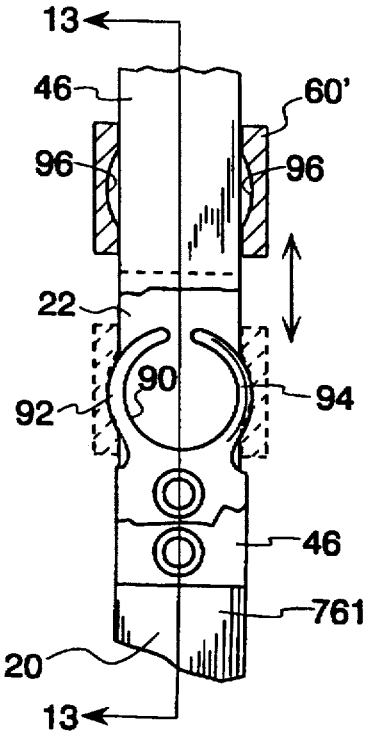
FIG. 12 is a fragmentary front elevational view of another mounting arrangement according to principles of the present invention.
Figure 13:
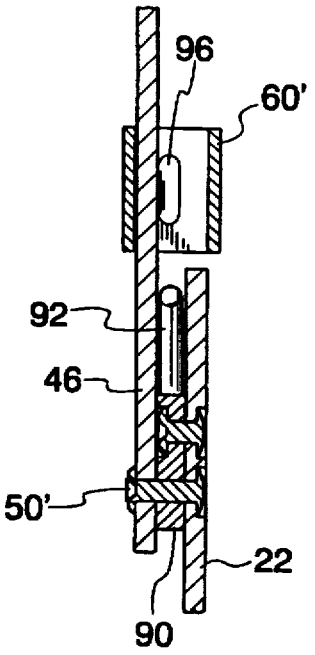
FIG. 13 is a cross-sectional view taken along the line 13—13 of FIG. 12.

Referring to FIGS. 12 and 13, a further example of a camming member is shown in the form of a split ring structure 90 with arcuate ears 92, 94 which are resiliently inwardly deflectable toward one another. The sliding collar 60' is preferably provided with a pair of arcuate recesses 96 to receive and seatingly engage the arcuate members 92, 94. As shown in FIG. 12, the split ring structure 90 comprises part of a washer 76' which, as in the arrangement shown in FIG. 11, is located between an upright support member and a finger portion. However, unlike the arrangement of FIG. 11, the recesses 84 are not required. Instead, recesses 96 formed in sliding collar 60 are brought into engagement with the arcuate portions 92, 94 as sliding collar 60' is moved in the downward direction of FIGS. 12 and 13. One advantage of the ring-shaped configuration shown in FIG. 12 is that the outer surfaces of the arcuate portions 92, 94 provide convenient camming surfaces for the bore wall defining the interior bore of sliding collar 60'. Thus, as the bottom end of sliding collar 60' engages the arcuate portions 92, 94, the free end of the arcuate portions are pressed toward one another, closing the gap shown in FIG. 12. With continued insertion of the sliding collar 60', the arcuate portions 92, 94 enter the recess pockets 96 and are allowed to expand in an outward direction, locking the sliding collar 60' in place. Since the sliding collar 60' surrounds not only the spacer 76' but the support staff and finger portion as well, resilient arcuate portions could be provided on the support staff and/or the finger portion and the pocket recess 96 relocated to a line so as to receive the arcuate portions. However, in the preferred embodiment, neither the mounting staff nor the finger portions are made of resilient material and, accordingly, it is preferred that the arcuate portions be formed as part of a washer member located between the mounting staff and finger portion members.

Figure 14:
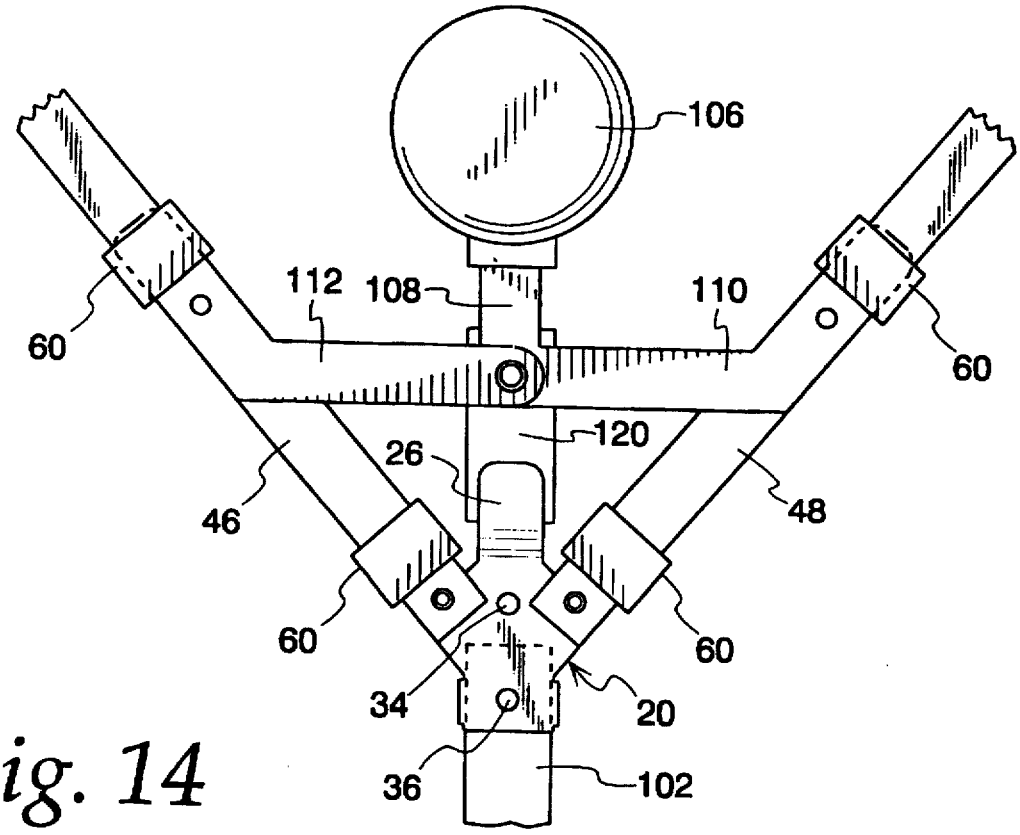
FIG. 14 is a front elevational view of a further alternative mounting arrangement according to principles of the present invention.

Turning now to FIG. 14, an alternative mounting arrangement for a warning device includes an upright support member of flat rib, cylindrical or other configuration, designated by the reference numeral 102. A mounting bracket 20 is attached to the upright support member 102 in the manner indicated above, either by use of a mounting band and/or a fastener received in aperture 36. A pair of mounting staffs 46, 48 are secured to bracket 20 in the manner indicated above with respect to FIG. 6, and sliding collars 60 are employed for the purpose. A warning device such as a reflector or flashing light 106 is mounted by a vertical post 108 extending from one end of an angled arm 110. As shown in FIG. 14, the angled arm 110 is of generally V-shaped configuration, having a first arm portion extending in a generally horizontal direction and a second arm portion extending along mounting staff 48. As indicated in FIG. 14, a sliding collar 60 is inserted over the overlapping joinder of the angled arm and mounting staff. A second angled arm 112, preferably comprising a mirror image of angled arm 110, has a first end pinned at 114 to angled arm 110 and a second end overlapping mounting mast 46 and secured to the mounting mast with another sliding collar 60. Mounting mast 120 is pinned at the joinder of angle arms 110, 112 so as to be pivotable from a storage position overlapping the angled arms to an open position aligned with central finger 26. A locking collar 60 (not shown in FIG. 14) locks the mounting staff 120 to central finger 26 in the manner indicated in FIG. 6. If desired, mounting staff 120 can be shortened, having a upper end abutting the angled arms 110, 112 to provide support from below or, as a further alternative, the mounting staff 120 can be omitted. Further, the offset 148 could be omitted, if desired, and/or the staff can be pinned to the bracket for pivoting connection.

Figure 15:
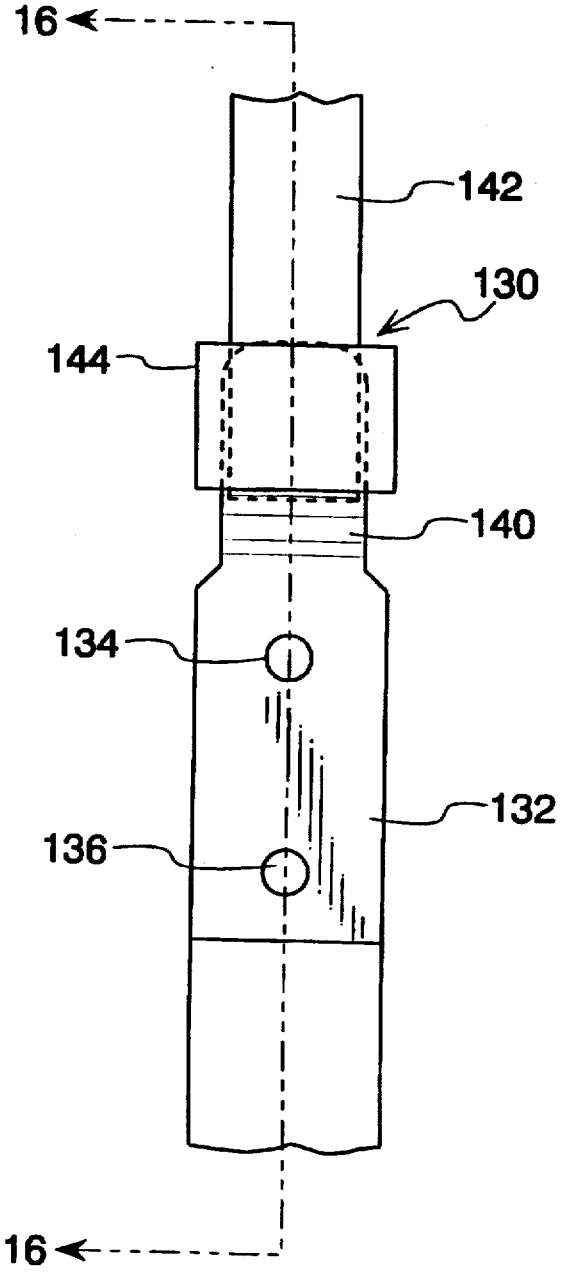
FIG. 15 is a front elevational view of an alternative embodiment according to the principles of the present invention.
Figure 16:
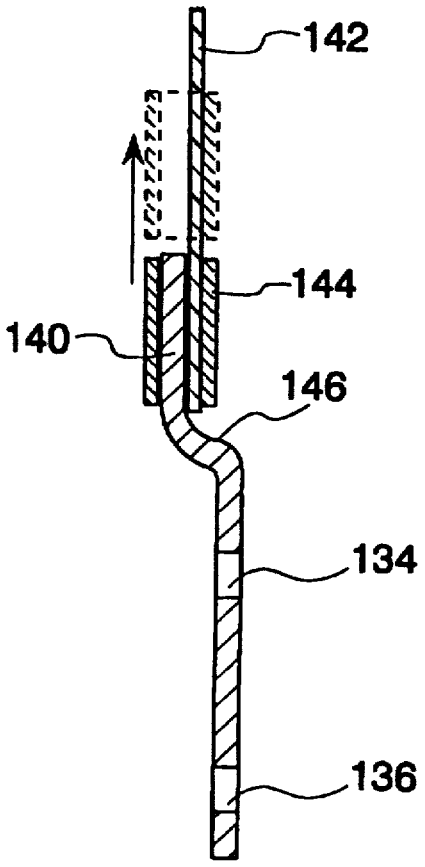
FIG. 16 is a cross-sectional view taken along the line 16—16 of FIG. 15.

Turning now to FIGS. 15 and 16, an alternative mounting arrangement is generally indicated at 130 and includes a mounting bracket 132 having apertures 134, 136 to receive threaded fasteners for securement to a mounting surface. A finger portion 140 extends in an upward direction. A mounting staff 142 has a lower end overlying the finger portion 140 and is joined thereto with a sliding collar 144. A stop surface 146 is provided by offset 148 for convenient alignment of staff 142 with respect to finger portion 140 and bracket 132.

Figure 17:
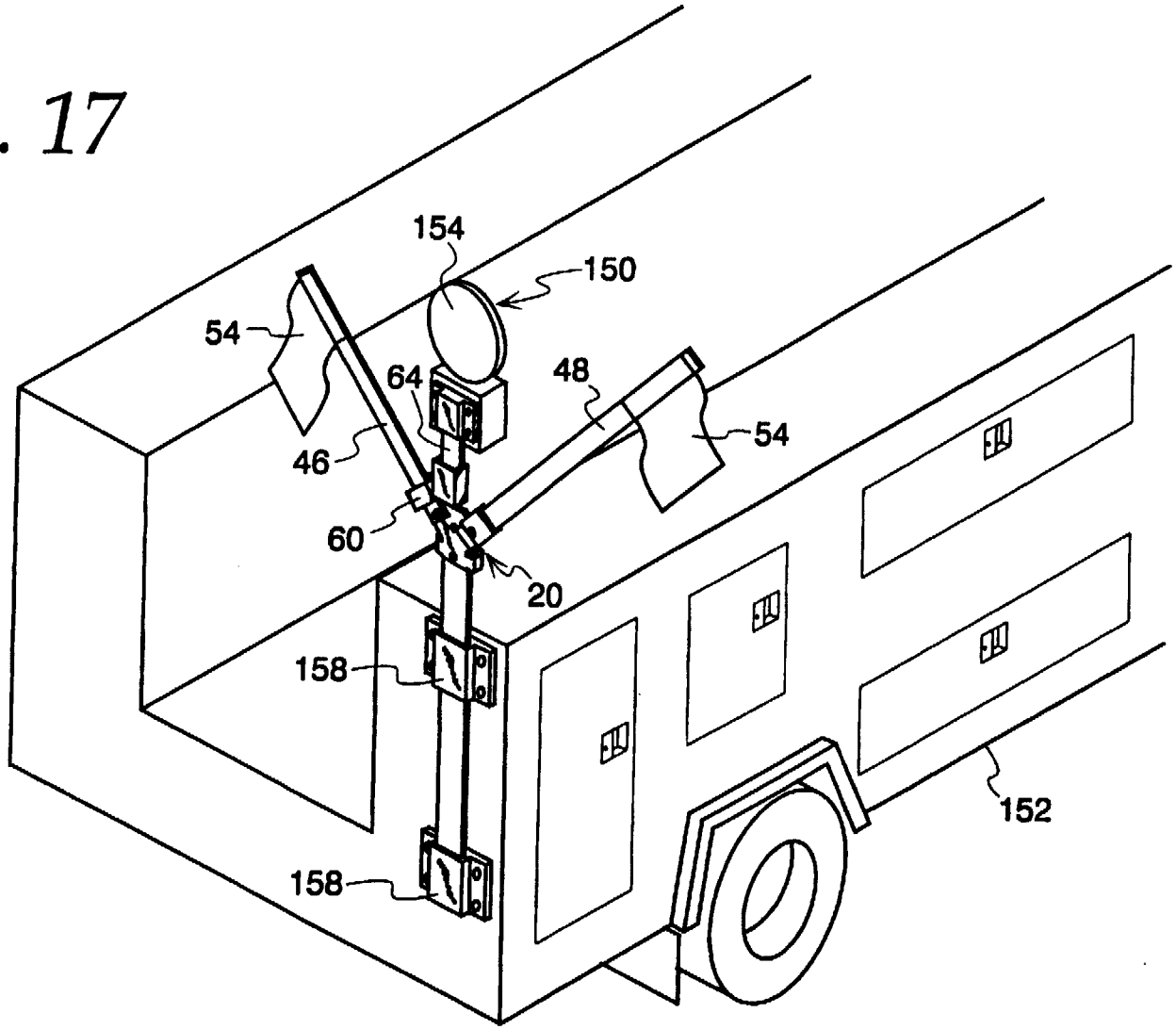
FIG. 17 is a fragmentary perspective view of a vehicle with mounting assembly according to the principles of the present invention.
Figure 18:
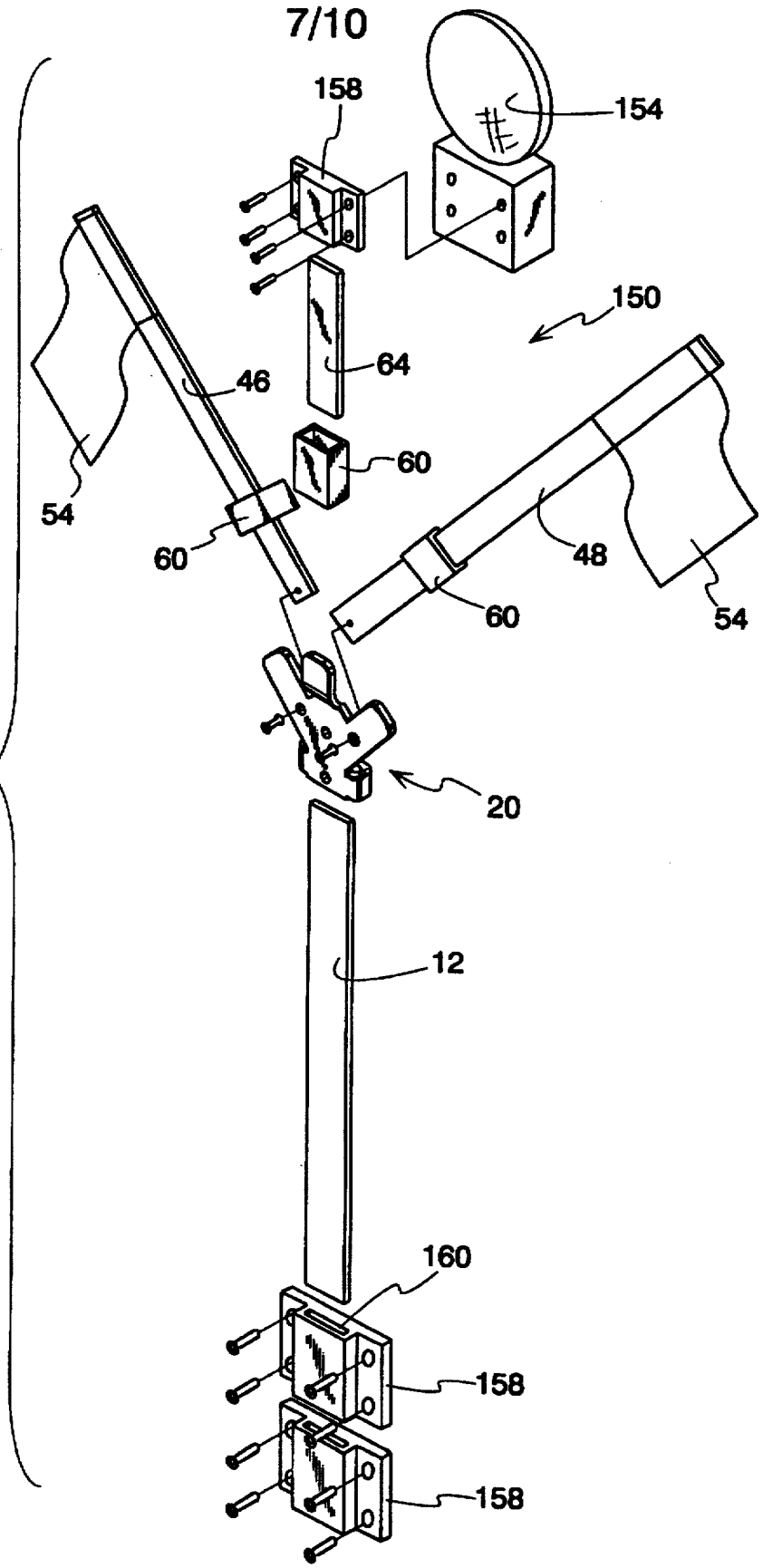
FIG. 18 is a fragmentary exploded perspective view thereof.

Turning now to FIGS. 17 and 18, another alternative mounting arrangement according to the principles of the present invention is generally indicated at 150. Mounting arrangement 150 is similar to the arrangement 10 shown in FIG. 1, with two exceptions. First, message panel 14 is omitted and the upright support member 12 is supported by a vehicle 152. Secondly, the central flag 54 is omitted and replaced by a warning light 154 mounted atop the central mounting staff 64. Mounting blocks 158 include a central aperture 160 for receiving the upright support member 12. Preferably, the mounting blocks 158 are made of a relatively hard rubber to provide a resilient sound-deadening cushioning for the upright support member. Preferably, the mounting blocks 158 are secured directly to vehicle 152 and two or more mounting blocks are provided in the manner indicated in FIG. 17 to orient the upright support member 12 in the preferred direction. In the preferred embodiment, warning light 154 includes a strap member to receive the upper end of mounting staff 64. This is conveniently provided by employing a bracket 158 for the purpose, as shown in FIG. 18.

Figure 19:
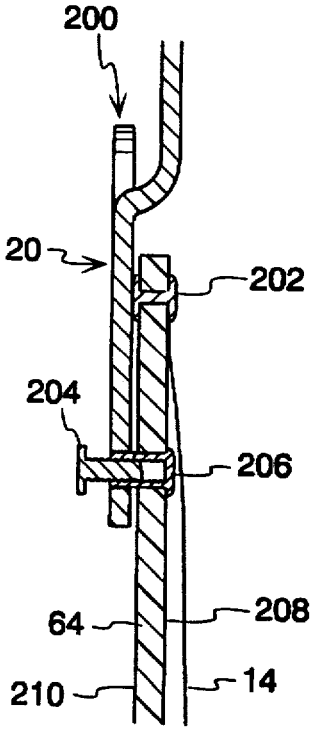
FIG. 19 is a fragmentary cross-sectional view similar to that of FIG. 7 but showing an alternative mode of installing the mounting assembly.

Referring now to FIG. 19, a further alternative mounting arrangement is generally indicated at 200. Mounting staff 64 has a flexible message panel 14 attached thereto with a conventional fastener 202. Mounting bracket 20 is secured with a conventional fastener 204 to the mounting staff 64. It is preferred that the "blind" end 206 of fastener 204 provide a low profile or approximately flush fit with the hidden side 208 of mounting staff 64 so as to avoid damage to flexible mounting panel 14. It is also preferred that the fastener 202 provide a flush fit with the exposed face 210 of mounting staff 64 so as to minimize substantial inclination of mounting bracket 20 away from a vertical orientation.

Figure 20:
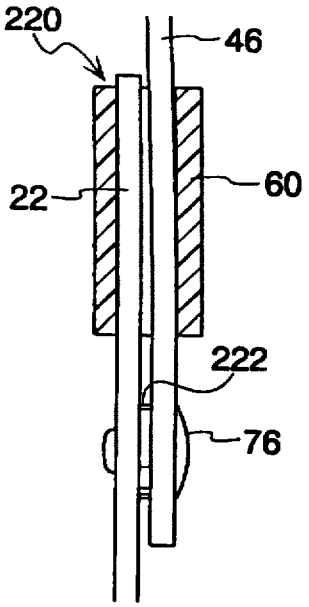
FIG. 20 is a fragmentary cross-sectional view similar to that of FIG. 9 but showing an alternative mounting arrangement.
Figure 21:
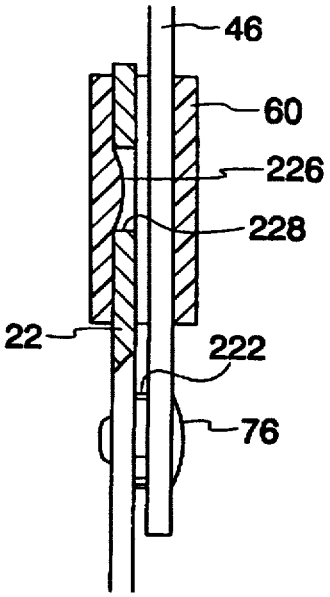
FIG. 21 is a fragmentary cross-sectional view showing a further alternative mounting arrangement.
Figure 22:
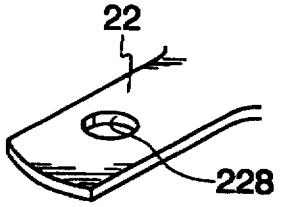
FIG. 22 is a fragmentary perspective view of the mounting member shown in FIG. 21.

Referring now to FIGS. 20–22, an alternative locking arrangement is generally indicated at 220. Staff 46 is held away from outer finger 22 by a spacer washer 222. Inner cavity of sliding collar 60 is chosen to have a width slightly less than the total combined with of finger 22, mounting staff 46 and spacer washer 222, as seen in FIG. 20. As the sliding collar is advanced toward fastener 76, mounting staff 46 and finger 22 are drawn together, preferably with the bending being localized in mounting staff 46. In FIG. 21, the sliding collar 60 is provided with an inwardly facing protrusion 226 which is received in an aperture 228 formed in finger 22. The width of the internal cavity of sliding collar 60, as illustrated in FIG. 21, is preferably dimensioned to accommodate the full combined width of finger 22, spacer washer 222 and mounting staff 46. Alternatively, the width of the internal cavity of mounting collar 60 can be reduced, in the manner explained above with reference to FIG. 20, to provide a bias force to maintain locking engagement of protrusion 226 within hole 228.

Figure 23:
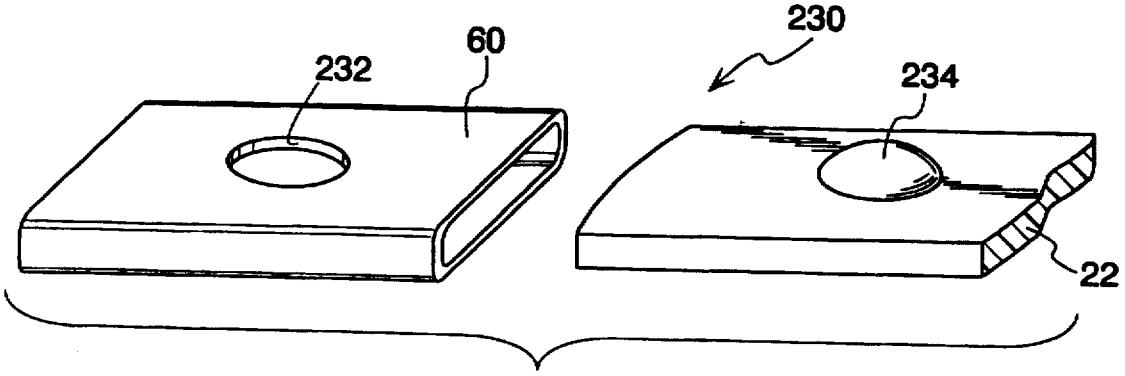
FIG. 23 is an exploded perspective view showing a further alternative mounting arrangement.

Referring now to FIG. 23, a locking arrangement generally indicated at 230 is illustrated with an aperture 232 formed in mounting collar 60 so as to engage a protrusion 234 formed in finger 22. Alternatively, protrusion 234 can be provided on mounting staff 46.

Figure 24:
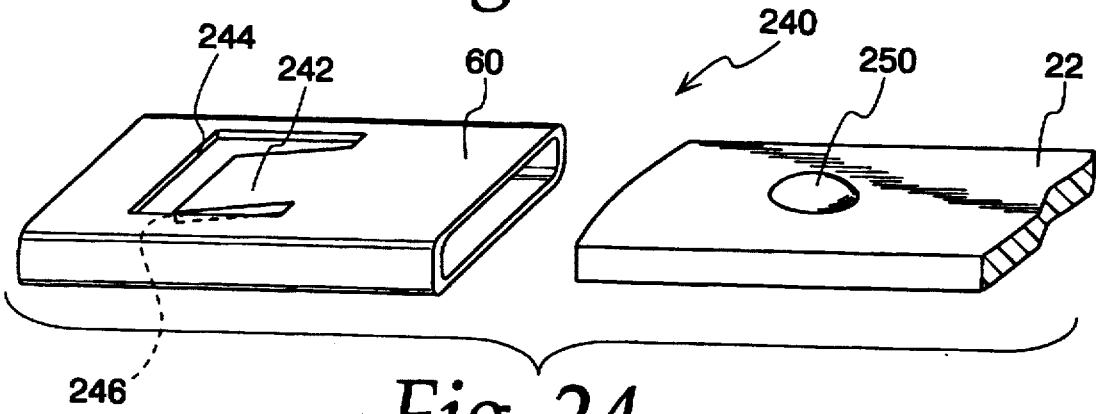
FIG. 24 is an exploded perspective view showing another alternative mounting arrangement.

Referring now to FIG. 24, a locking arrangement 240 is illustrated with a locking finger 242 formed by a cut-out 244 in one major wall of mounting collar 60. Preferably, finger 242 is set in an inward direction such that its inner corner 246 protrudes within the interior 248 of the mounting collar. Finger 22 is provided with a recess 250 for receiving the corner 246 of finger 242. If desired, the recess 250 could be formed in mounting staff 46.

For example, the protrusion 234 could be provided in a form resembling a thumbtack having a stem received in a hole formed in the mounting staff.

Figure 25:
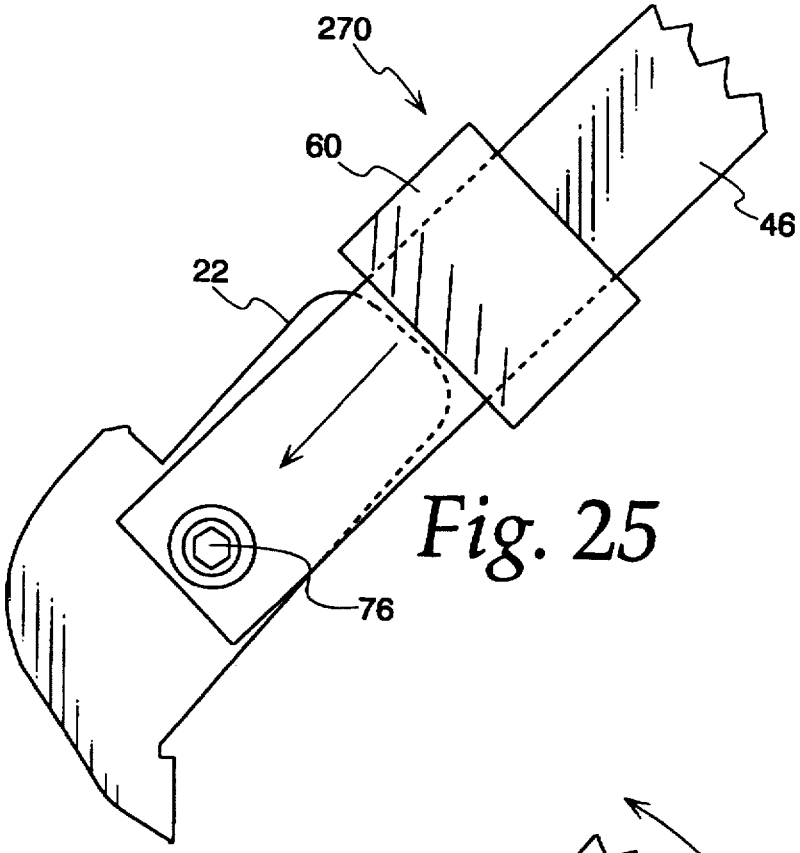
FIGS. 25 and 26 are front elevational views showing a further alternative mounting arrangement.
Figure 26:
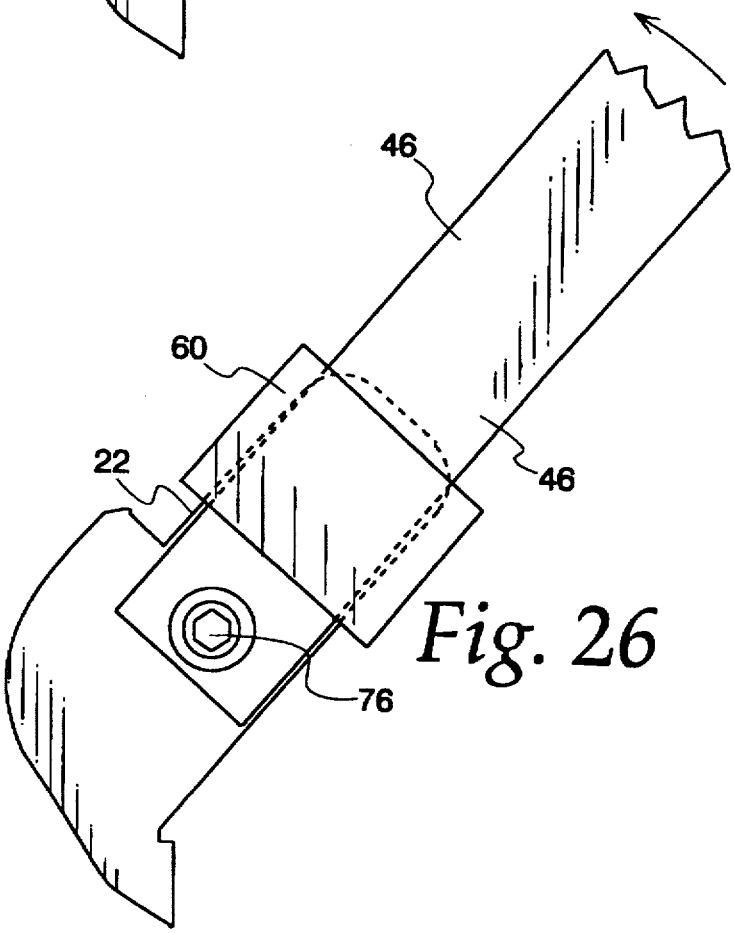

Referring now to FIGS. 25 and 26, an alternative locking arrangement is shown as indicated at 270. As illustrated in FIGS. 25 and 26, mounting staff 46 is laterally offset a slight amount with respect to finger 22. The inner cavity of sliding collar 60 is closely dimensioned with respect to the width of mounting member 46. As a result of the relative sizing of the mounting collar and mounting staff and the lateral offset, the internal walls of the mounting collar will become wedged against the minor surfaces of the finger 22 and mounting staff 46, in a region located above the fastener 76.

Figure 27:
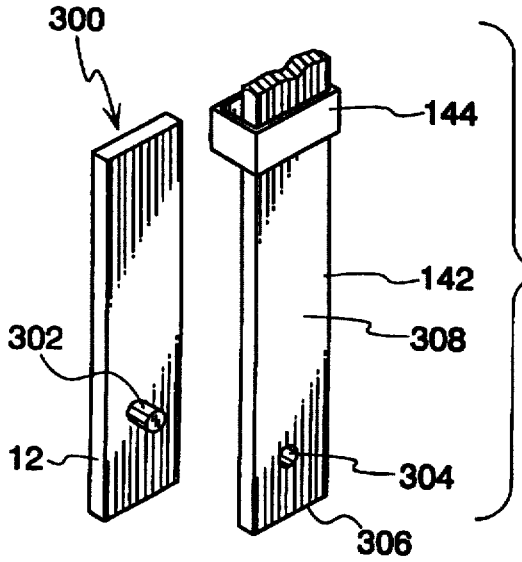
FIG. 27 is a fragmentary perspective view of another mounting arrangement.

Referring now to FIG. 27, an alternative mounting arrangement is generally indicated at 300. A rib member 12 is provided with a stud 302 to be received in an aperture 304 formed in mounting staff 142, as the rib member and mounting staff are brought into contact with one another. Thereafter, the sliding collar 144 is lowered so as to encircle the upper portion of rib member 12. If desired, any of the locking arrangements described above could be employed to secure sliding collar 144 against movement past the lower end 306 of mounting staff 142. For example, the off-center binding arrangement described above with respect to FIGS. 25 and 26 could be employed to wedge or otherwise stop sliding collar 144 at a point generally above stud 302. If desired, the stud 302 could be extended so as to protrude beyond the exposed major face 308 of mounting staff 142 so as to interfere with sliding collar 144.

Figure 28:
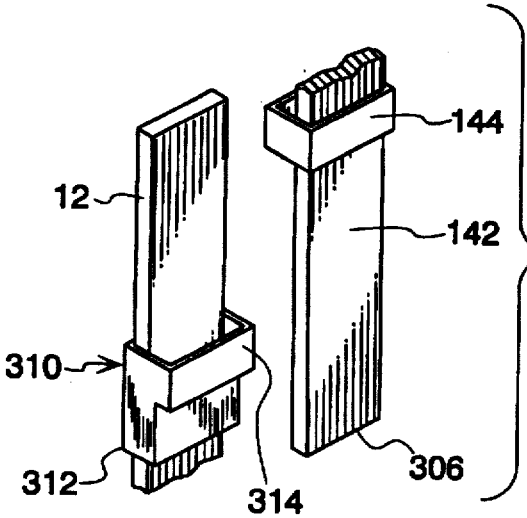
FIG. 28 is a fragmentary perspective view of a further alternative mounting arrangement.

Referring now to FIG. 28, rib member 12 is fitted with a stop member 310 which includes a body portion 312 for engaging rib member 12 with a gripping non-slip fit. For example, stop member 310 could be made of a rigid material and secured to the outer surfaces of rib 12 with a suitable adhesive. Preferably, however, stop member 310 is made of a resilient material such as a molded rubber which engages rib member 12 with a gripping fit, without requiring use of adhesives. Stop member 310 includes a collar portion 314 having a closed bottom. The lower end 306 of mounting staff 142 is inserted in the closed bottom collar portion 314 of stop member 310 as rib member 12 and mounting staff 142 are brought together. Sliding collar 144 is then lowered past the upper end of rib 12. Again, any of the locking arrangements described above can be employed to maintain sliding collar 144 at a desired spacing above stop member 310. For example, with the stop member 310 formed of rigid material, rib 12 and the lower end 306 of mounting staff 142 can be laterally off-set from one another, with the upper part providing a binding engagement with the sliding collar 144, in the manner described above with reference to FIGS. 25 and 26. Alternatively, the stop member 310 is made of resilient elastomeric material so as to provide a lateral off-set between the lower end 306 of mounting staff 142 and rib 12, a resiliently biased wedge fit will result.

Figure 29:
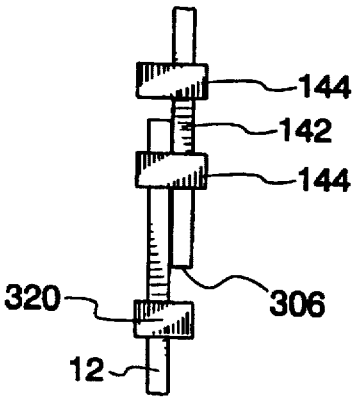
FIG. 29 is a side elevational view of a further mounting arrangement.

Referring now to FIG. 29, rib 12 is provided with a band 320 secured adjacent the upper portion of rib 12. Band 320 could comprise a rubber ring, for example, or multiple windings of a suitable adhesive tape. The rib member 12 and mounting staff 142 are brought together in a manner described above, and the lower end 306 of mounting staff 142 is lowered until contact is made with stop band 320. Thereafter, a pair of sliding collars 144 are slid over the overlapping portions of rib 12 and mounting staff 142. The sliding collars are preferably maintained in a spaced apart condition. For example, any of the locking arrangements described above could be employed. For example, multiple protrusions can be provided on rib 12 or mounting staff 142 or both in a manner described above with reference to FIGS. 20–24.

Figure 30:
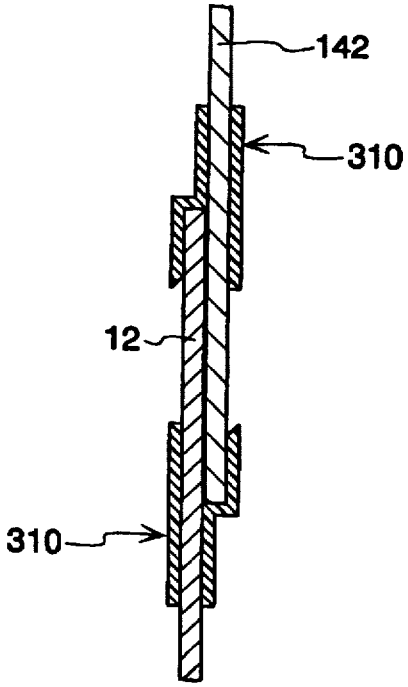
FIG. 30 is a longitudinal cross-sectional view of a further alternative mounting arrangement.

Referring now to FIG. 30, a pair of stop members 310 are employed, one associated with rib member 12 and the other associated with mounting staff 142. Preferably, the stop members 310 are affixed beforehand, with the free ends of rib 12 and mounting staff 142 being brought into engagement with one another, with mounting staff 142 thereafter being lowered in a longitudinal direction so as to substantially simultaneously seat the upper end of rib 12 in the pocket of upper stop member 310, while seating the lower free end of mounting staff 142 in the pocket of the lower stop member. Preferably, the stop members 310 are made of resilient material so as to provide a slip-resistant gripping engagement with their respective rib and mounting staff. However, if desired, the stop members 310 could be made of a rigid material secured to their respective rib and mounting staff members with the arrangement shown in FIGS. 20–24 or other suitable mounting arrangements, such as those employing use of adhesives.

As mentioned above, the mounting staffs and upright support member preferably have a flat rib configuration and are preferably made of conventional fiber glass material. However, the present invention also contemplates the use of upright support members and mounting staffs which have different configurations, such as square tube, cylindrical, T-shape, L-shape or other configurations.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Apparatus for displaying a plurality of warning devices, comprising:

a body including a generally planar plate portion with a plurality of spaced apart angularly offset fingers;

a plurality of mounting staffs;

pivot means adjacent each finger for pivotally mounting a respective one of said mounting staffs to the body for pivotal alignment in overlying relationship with the respective finger; and a sliding band means, slidable along each mounting staff to surround the respective finger to prevent further pivoting of the mounting staff with respect to the finger.

2. The apparatus of claim 1 wherein the pivot means comprise pin means extending through the mounting staff and the body.

3. The apparatus of claim 2 wherein the pin means includes a rivet.

4. The apparatus of claim 1 further comprising:

an upright support member; and a mounting band carried by the body and defining an internal opening for receiving the upright support member and having engagement means to engage the upright support member for securement thereto.

5. The apparatus of claim 1 wherein the plurality of fingers lie in a common plane.

6. The apparatus of claim 5 wherein the plurality of fingers and the central portion is stamped from a unitary piece of sheet metal.

7. The apparatus of claim 6 wherein the mounting band is stamped from a unitary piece of sheet metal.

8. Apparatus for mounting a warning device to a support object, comprising:

an upright support member;

a monolithic one-piece body including a generally planar plate portion with a plurality of fingers outwardly and upwardly extending therefrom;

a compressible mounting band defining an internal opening for receiving the upright support member and compressible so as to engage the upright support member for securement thereto;

a plurality of mounting staffs;

a plurality of pivot means for pivotally mounting respective mounting staffs to the body for pivotal alignment in overlying relationship with respective fingers;

a sliding band, slidable along each mounting staff to surround the respective finger to prevent further pivoting of the mounting staff with respect to the finger;

an upright support member extending from the body to the mounting band; and means for attaching the upright support member to the body.

9. Apparatus for displaying a plurality of warning devices, comprising:

a body including a generally planar plate portion with a plurality of spaced apart angularly offset fingers;

a plurality of mounting staffs;

pivot means adjacent each finger for pivotally mounting a respective one of said mounting staffs to the body for pivotal alignment in overlying relationship with the respective finger;

a sliding band means, slidable along each mounting staff to surround the respective finger to prevent further pivoting of the mounting staff with respect to the finger; and captive means for holding the sliding band captive on the finger.

10. The apparatus of claim 9 wherein said the first finger includes an outwardly directed protrusion comprising said captive means and said pivot means holds a mounting staff in a spaced overlying relationship with said the first finger such that said mounting staff is deflectable toward and away from the free end of such finger so as to allow passage of said sliding band past said protrusion.

11. The apparatus of claim 9 wherein said the first finger includes an outwardly directed protrusion comprising said captive means and said pivot means holds a mounting staff in a spaced overlying relationship with said the first finger such that said mounting staff is deflectable toward and away from the free end of such finger so as to allow passage of said sliding band past said protrusion, said sliding band including a protrusion facing said finger when slid therealong, and said finger defines the first recess for receiving said protrusion.

* * * * *